US005279079A

United States Patent [19]

Tyler et al.

[11] Patent Number: 5,279,079

[45] Date of Patent: Jan. 18, 1994

[54] ADHESIVE BONDED ABRASIVE FINISHING TOOL

[75] Inventors: James B. Tyler, Westlake; Alfred F. Scheider, Orange; R. Brown Warner, Westlake, all of Ohio

[73] Assignee: Jason, Inc., Cleveland, Ohio

[21] Appl. No.: 889,268

[22] Filed: May 28, 1992

Related U.S. Application Data

[62] Division of Ser. No. 471,383, Jan. 29, 1990, Pat. No. 5,129,197.

[51] Int. Cl.[5] ..... B24D 9/00

[52] U.S. Cl. ..... 51/358; 51/360; 51/397

[58] Field of Search ..... 51/331, 332, 358, 360, 51/391, 392, 394, 397, 403, 293, 180, 159; 15/180, 159A; 300/21

[56] References Cited

U.S. PATENT DOCUMENTS

| | | | |
|---|---|---|---|
| 2,049,324 | 7/1936 | Schneider | 51/337 |
| 2,421,647 | 6/1947 | Peterson | 15/180 |
| 3,643,282 | 2/1972 | Lechene et al. | 15/179 |
| 4,285,171 | 8/1981 | Block et al. | 51/337 |
| 4,305,234 | 12/1981 | Pichelman | 51/330 |
| 4,364,746 | 12/1982 | Bitzer et al. | 51/307 |
| 4,625,466 | 12/1986 | Saigusa | 51/403 |

*Primary Examiner*—M. Rachuba

*Attorney, Agent, or Firm*—Renner, Otto, Boisselle & Sklar

[57] ABSTRACT

A rotary finishing tool and a method for making the same characterized by a rolled or coiled strap of plastic material with abrasive homogeneously embedded throughout. The coiled strap is secured to the bottom interior surface of a cup element by a thin layer of liquid quick setting or instant adhesive. The strap may include transverse slits or serrations to provide the degree of flexure desired and/or to provide fracture lines. To make the tool, a longitudinally extending strap of an abrasive containing plastic material is heated and rolled along its longitudinal axis thereby forming a lightly coiled strap. A cup element is supported and the coiled strap is driven into the cup element whereby one end face of the coiled strap is driven into contact with a thin layer of the instant adhesive. Upon curing of the adhesive, the one end face is secured to the bottom interior surface of the cup element, and the opposite or outer end face becomes the working face of the tool.

22 Claims, 2 Drawing Sheets

ADHESIVE BONDED ABRASIVE FINISHING TOOL

This is a divisional of co-pending application Ser. No. 07/471,383 filed on Jan. 29, 1990 now U.S. Pat. No. 5,129,197.

This invention relates generally as indicated to an adhesive bonded abrasive finishing tool including a method of making the same, and more particularly to a low cost and light weight end brush type abrasive tool which is particularly suited to automatic or robotics spot facing applications.

BACKGROUND OF THE INVENTION

Abrasive tools utilizing rectangular in section nylon monofilaments with abrasive grains embedded homogeneously therein throughout, have been employed to make abrasive finishing tools. Examples of such tools may be seen in the prior applications for U.S. Letters Patent of Alfred F. Scheider et al, Ser. Nos. 216,710 and 409,680 entitled "Rotary Abrasive Tool and Filament Therefor" and "Abrasive Finishing Tool", respectively, filed Jul. 8, 1988 and Sep. 20, 1989, respectively, and the prior applications of R. Brown Warner et al entitled "Flexible Abrasive Grinding Tool", filed Jul. 8, 1988, and "Adhesive Bonded Flexible Abrasive Finishing Tool", Ser. No. 228,438, filed Aug. 5, 1988. Such tools have proven to be very effective in the abrasive finishing of a wide variety of workpieces such as those made of exotic alloys and composites.

End brushes or finishing tools are often manufactured utilizing rings, sleeves, pins or keys as anchors to secure the filament bundle in the cup of the shank with the filament bundle being folded as a hairpin in the cup. This results in a non-uniform distribution and density of the filaments and also normally requires secondary operations such as trimming of the brush face and crimping or swaging of the lip of the cup. Such internal anchors can in and of themselves affect the dynamic balance of the tool quite apart from causing non-uniform distribution of the filaments. Examples of end brushes or tools using mechanical anchors or keys may be seen in prior U.S. Pat. Nos. 2,982,983; 3,312,993; and 2,421,647.

As illustrated in prior application Ser. No. 228,438, bundles of discrete monofilaments may be bonded to the bottom interior surface of a cup element to form end brush type tools. The manufacture of such tools from discrete monofilaments may be difficult and expensive. Such bundles are difficult to handle and form, particularly if a precise tool size and form is desired. Moreover, for some workpieces an even more aggressive tool is desirable.

SUMMARY OF THE INVENTION

The present invention provides a rotary finishing tool and a method for making the same. The tool includes a cup element and a coiled strap or tape of an abrasive containing plastic material. An end face of the coiled strap is secured to the bottom interior surface of the cup element by a thin layer of liquid quick setting or instant adhesive. The strap may include transverse slits or serrations to provide the degree of flexure desired and/or to provide fracture lines. To make the tool, a longitudinally extending strap of an abrasive containing plastic material is heated and rolled along its longitudinal axis thereby forming a tightly coiled strap. A cup element is supported and the coiled strap is secured to the bottom interior surface of the cup element. To secure the coiled strap to the cup element, an adhesive is placed in the cup element. The coiled strap is then driven into the cup element whereby an end face of the coiled strap is driven into contact with the adhesive. Upon curing of the adhesive, such end face is secured to the bottom interior surface of the cup element, and the opposite or outer end face becomes the working face of the tool.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
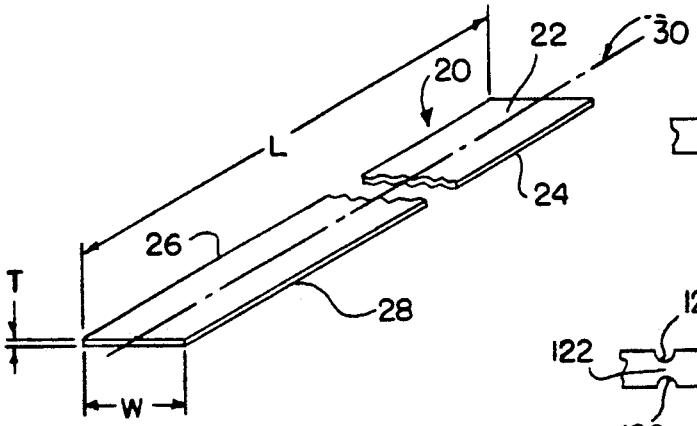
FIG. 1 is a broken perspective of a strap of a plastic abrasive containing strap or tape used to form a finishing tool according to the present invention.

Referring now to the drawings in detail and particularly to FIG. 1, a longitudinally extending strap 20 made from an abrasive containing material is shown. The strap 20 has a first or top surface 22, a second or bottom surface 24, and longitudinal edges 26 and 28. The strap 20 resembles a tape or a roughly rectangular band having a longitudinal axis 30. The strap 20 has a relatively thin uniform thickness T, a width W which is approximately 5 to 50 times or more the thickness, and a length L substantially greater than the width W. While the dimensions of the strap 20 may vary widely, the thickness of the strap may be about 0.030 inch and may vary in the English system of measurement from about 0.020 inch to approximately 0.050 inch. The width may vary from approximately one inch to approximately 6 inches. In the metric system the thickness may be approximately 1 mm and the width at its higher range may be slightly more than 15 cm. Preferably, the width of the strap is 5 times the thickness but may be 50 or more times the thickness. A preferred width to thickness ratio is about 30:1, or 3 cm to 1 mm, for example.

The manufacture and material make-up of the strap 20 is described in detail in applicants' copending application entitled "Abrasive Finishing Elements, Tools Made From Such Elements, And Methods of Making Such Tools", Ser. No. 908,981, filed even date herewith, the entire disclosure of which is incorporated herein by reference.

Briefly, the strap 20 is preferably formed by extrusion of a non-elastomeric plastic melt extrudate through a ceramic die opening. The preferred plastic for extrusion of the strap 20 is nylon and the preferred nylon is 6/12 nylon. Nylons are long-chain partially crystalline synthetic polymeric amides (polyamides). Polyamides are formed primarily by condensation reactions of diamines and dibasic acids or a material having both the acid and amine functionality. Nylons have excellent resistance to oils and greases, in solvents and bases. Nylons have superior performance against repeated impact, abrasion, and fatigue. Other physical properties include a low coefficient of friction, high tensile strength, and toughness. Useful mechanical properties of nylon include strength, stiffness and toughness. In general, the greater the amount of amide linkages, the greater the stiffness, the higher the tensile strength, and the higher the melting point. Several useful forms of nylon are available and include:

A. Nylon 6/6 synthesized from hexamethylenediamine (HMD) and adipic acid;
B. Nylon 6/9 synthesized from HMD and azelaic acid;
C. Nylon 6/10 synthesized from HMD and sebacic acid;
D. Nylon 6/12 synthesized from HMD and dodecanedioic acid;
E. Nylon 6 synthesized from polycaprolactam;
F. Nylon 11 synthesized from 11-aminoundecanoic acid;
G. Nylon 12 synthesized from polyaurolactam; and others.

Nylons useful in the present invention have a Young's modulus greater than 0.05, preferably greater than 0.1 and preferably greater than 0.2. Young's modulus is defined as the amount of force a material can undergo without permanent deformation when the force is removed. This is a measure of elasticity or the relationship of stress over strain.

The preferred nylon as indicated is nylon 6/12. The physical properties of nylon 6/12 include a melting point of 212° C., a dry yield strength at $10^3$ psi of 8.8 (7.4 at 50% RH), a dry flexural modulus of 295 (180 at 50% RH). Nylon has a higher Young's modulus (0.40 at $10^6$ psi) than rubber (0.01 at $10^6$ psi), which demonstrates the greater stiffness of nylon over an elastomer such as rubber, for example. As an example, a working element according to the present invention several feet long when held horizontally at one end at room temperature would show little or minimal deflection at the opposite end.

Nylon is partially crystalline, hence has little or no rubbery regions during deformation. The degree of crystallinity determines the stiffness and yield point. As the crystallinity decreases the stiffness and yield stress decreases. Rubber, on the other hand, is an amorphous polymer and its molecular straightening leads to a low modulus of elasticity.

Nylon has a tensile strength of over 8000 psi, rubber has a tensile strength of 300 psi. Nylon exhibits 250% breakage during elongation, rubber exhibits 1200%. Nylon has fair moisture resistance, yet rubber absorbs a large amount of water. Nylon has excellent resistance to oil and greases and other organic solvents, rubber has extremely poor resistance. Nylon retains its properties from −75° F. to 230° F., while rubber has a narrow range around room temperature. Nylon's increased strength, resistance to moisture and solvents, and its wide usable temperature range make it the preferred material for this construction.

Another type of polyamide useful in the present invention include other condensation products with recurring amide groups along the polymer chain, such as aramids. Aramids are defined as a manufactured fiber in which at least 85% of the amide (—C(O)—N(H)—) linkages are attached directly to two aromatic hydrocarbon rings. This is distinguished from nylon which has less than 85% of the amide linkages attached directly to the two aromatic rings.

Aramid fibers are characterized by high tensile strength and high modulus. Two aramides that may be useful in the present invention include fiber formed from the polymerization of p-phenylenediamine with terephthaloyl chloride. The positioning of the groups on the aromatic rings tend to make this aramid a stiffer polymer. A less stiff polymer is formed from a m-phenyldiamine and isophthaloyl chloride. A meta substitution leads to more flexibility. Aramids demonstrate a very strong resistance to solvents. Aramids have tensile strengths at 250° C. that are exhibited by textile fibers at room temperature.

Also, some thermoset polymers are useful. Polyesters are an example and are long chain synthetic polymers with at least 85% of a dihydric alcohol ester (HOROH) and terephthalic acid (p-$HOOCC_6H_4COOH$). Polyesters fibers contain both crystalline and non-crystalline regions. Polyesters are resistant to solvents and demonstrate a breaking elongation of 19 to 40%.

Polyimides are polymers containing (CONHCO) and are also useful in the present invention. High temperature stability (up to 700° F.) and high tensile strength (13,500 psi) make polyimides useful as binders in abrasive wheels.

The abrasive loading of the strap 20 is preferably between 30 and 45% by weight of the strap. Conventional abrasive minerals such as aluminum oxide or silicon carbide may be employed. However, more exotic abrasive minerals may be used such as polycrystalline diamond or cubic boron nitride. Also, the abrasive grit size may be varied from coarse to fine powders, the latter for extra fine polishing and highlighting effects on work parts.

Figure 11:
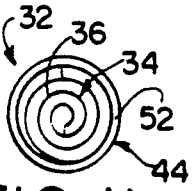
FIG. 11 is a top plan view of the tool of FIG. 10.
Figure 9:
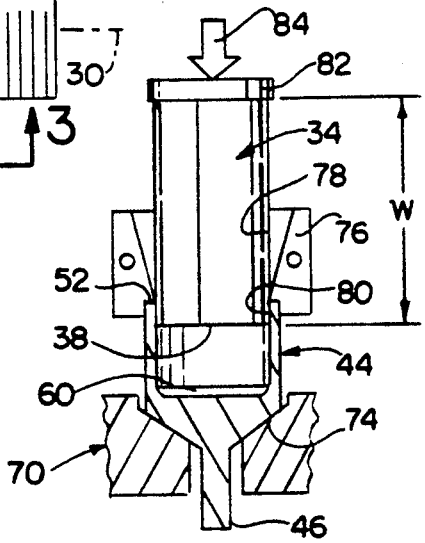
FIG. 9 is a schematic view of the coiled strap being driven axially into a cup element.
Figure 10:
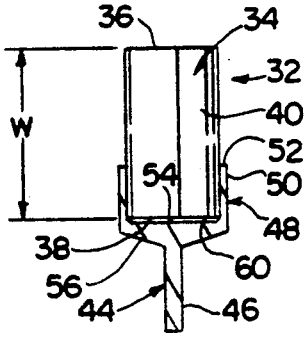
FIG. 10 is a front elevation of a completed rotary finishing tool according to the present invention made with unserrated or unslit strap, the strap being shown in elevation and the cup element being shown in section.

Referring now additionally to FIGS. 10 and 11, the strap 20 is used in a finishing tool according to the present invention indicated generally at 32. The tool 32 includes a rolled or tightly coiled strap 34 which is formed by rolling the strap 20 along its longitudinal axis 30 (see FIGS. 1 and 8). The coiled strap 34 has a first, or top, generally circular end face 36, a second, or bottom, circular end face 38, and a generally cylindrical wall 40 therebetween. Of course, the axial length of the wall 40 is the same as the width W of the strap 20. As is best seen in FIG. 9, the coiled strap 34 has a plurality of circular convolutions.

The tool 32 also includes a cup element, more specifically a metal shank 44, to which the coiled strap 34 is secured. The shank 44 has an axially projecting cylindrical arbor 46 which may be gripped by the collet of a power tool. The top of the shank is formed into a cup-shape portion shown generally at 48. This cup-shape portion 48 has an annular skirt 50 having a top lip 52 and a flat circular bottom wall 54 positioned normal to the axis of the shank. The annular skirt 50 extends upwardly around the coiled strap 34 approximately one-third of the axial length of the wall 40. The bottom of the cup-shape portion 48 tapers into the arbor 46 as indicated at 56.

The coiled strap 34 is secured to the shank 44 by the bonding of its end face 36 to the bottom wall 54 by a liquid instant adhesive seen at 60. The adhesive should completely and uniformly cover the bottom wall 54. The preferred adhesive is cyanoacrylate of low viscosity or high fluidity.

Useful with the present invention are alkyl cyanoacrylates having the formula:

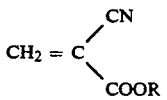

$R = CH_3$, $C_2H_5$, $C_3H_7$ etc.

A preferred cyanoacrylate adhesive is an alkoxy alkyl cyanoacrylate having the formula:

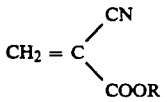

$R = CH_3—O—C_2H_5$, $C_2H_5—O—C_2H_5$

Suitable adhesives are available from Loctite Corporation of Newington, Conn. under the trademark SUPERBONDER® 495 or the trademark BLACK MAX. SUPERBONDER is a registered trademark of Loctite Corporation. BLACK MAX is also a trademark of Loctite Corporation.

The working element, or the coiled strap 34 of the tool 32 is of limited flexibility when compared to tools made from discrete monofilaments. Thus the tool 32 is desirable for workpieces requiring an aggressive tool.

Figure 7:
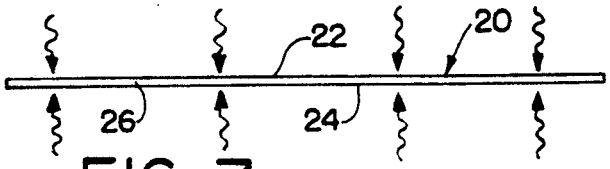
FIG. 7 is an edge elevation of the strap of FIG. 2 schematically showing the application of heat.
Figure 8:
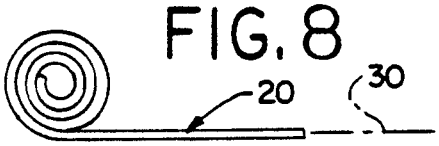
FIG. 8 is an edge elevation of the strap of FIG. 2 as it is being rolled into a coil.

Referring now to FIGS. 1, 7, 8 and 9, various steps of making the tool 32 are shown. The strap 20 is cut to the desired length and is heated as shown in FIG. 7 to place it in a more pliable condition. The relatively stiff plastic material may be heated and shaped or folded, and, when cooled, substantially retains its shaped or folded condition. After heating, the strap 20 is rolled along its longitudinal axis 30 as seen in FIG. 8 thereby forming the tightly coiled strap 34. The shank 44 is then supported in a jig 70 which may be provided with a hole 72 for accommodating the arbor 46. The jig 70 is provided with a tapered conical support surface 74 to ensure that the shank 44 is supported in a vertical upright position.

Next, the coiled strap 34 is secured to the bottom wall 54 of the shank 44. Specifically, an amount of liquid instant adhesive sufficient to cover the bottom wall 54 with a thin layer of adhesive 60 is placed in the shank. A split guide funnel 76 is then positioned on top of the lip 52 of the cup portion 48. The guide funnel 76 has an interior conical surface 78 which tapers to a shoulder 80 which is mounted on the lip 52 of the shank. At the shoulder, the internal diameter of the conical surface is the same as the internal diameter of the cup-shape portion 48 of the shank 44.

The coiled strap 34 is then placed within the funnel and driven downwardly by a pusher plate 82 by a suitable linear actuator as seen schematically by the arrow 84. In this manner, the end face 38 of the coiled strap 34 is driven into the liquid adhesive 60 which quickly sets, bonding the end face to the bottom wall 54 of the shank 44. Because of the low viscosity of the adhesive, some of the adhesive will penetrate between adjacent convolutions of the coiled strap adjacent the end face 38, bonding these portions to adjacent portions. A suitable pressure limit may retract the pusher plate 82. The split funnel 76 may be removed and the completed adhesive bonded flexible abrasive finishing tool 32 may be removed from the support jig. Although the illustrated tool has a hollow center, a core (not shown) may be provided to extend upwardly from the center of the bottom wall 54 of the shank 44, if desired. The core may be dimensioned to fit within the hollow center of the coiled strap 34.

Figure 3:
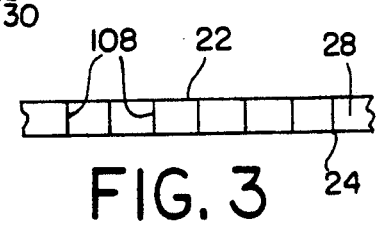
FIG. 3 is an enlarged edge elevation of the strap as seen from line 3—3 of FIG. 2.
Figure 2:
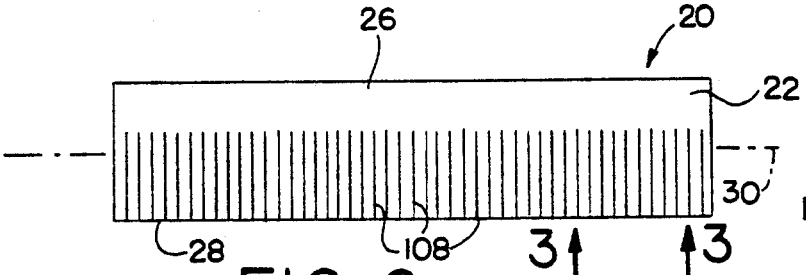
FIG. 2 is a top plan view of a cut to length strap similar to the strap of FIG. 1, but also including a series of slits extending from one edge.
Figure 13:
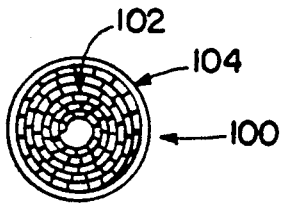
FIG. 13 is a top view of the tool of FIG. 12.
Figure 12:
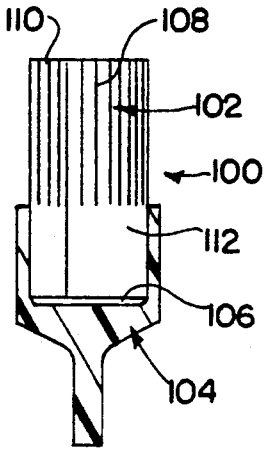
FIG. 12 is a front elevation of a rotary finishing tool according to the present invention made with a serrated or slit strap, the strap being shown in elevation and the cup element being shown in section.

Referring now to FIGS. 12 and 13, another form of a finishing tool according to the present invention is indicated generally at 100. The tool 100 is similar to the tool 32, in that it includes a generally cylindrical coiled strap 102 secured to a shank 104 by a thin layer of liquid adhesive 106. The coiled strap 102, however, includes a series of slits 108 extending from, and in a direction perpendicular to, its outer end face 110. The slits 108 extend completely through the strap 20 from the top surface 22 to the bottom surface 24 as seen in FIG. 3. In the illustrated tool 100, the slits 108 extend approximately two-thirds the width of the strap as seen in FIG. 2. The slits 108 divide the working element or strap into generally rectangular fingers of uniform width. The rectangular shape of the fingers thus provided may vary by controlling the spacing of the slits allowing various degrees of flexibility to be obtained. While the length of the slits 108 may also vary, they should not extend the entire width of the strap or axial length of the coiled wall 112 so that the shank 104 may grip an unslit edge portion of the strap.

The method of making the tool 100 includes all the steps noted above regarding making the tool 32. However, the method includes the additional step of cutting the strap 20 along its edge 28 in a direction transverse to its longitudinal axis 30. This cutting step is preferably performed before the heating and rolling steps, and creates the series of slits 108 shown in FIGS. 2 and 3.

Figure 4:
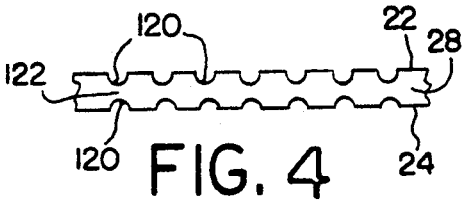
FIG. 4 is an enlarged edge elevation similar to that of FIG. 3; however instead of slits, the illustrated strap has a plurality of semi-circular serrations.
Figure 5:
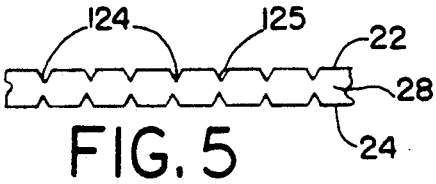
FIG. 5 is an enlarged edge elevation much like that of FIG. 4, showing triangular or pointed serrations.
Figure 6:
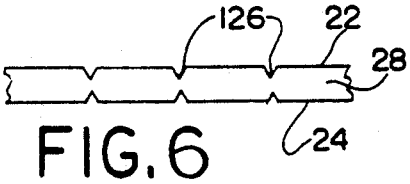
FIG. 6 is an enlarged edge elevation showing such serrations spaced further apart than in FIG. 5.

Instead of slitting, a series of score lines or serrations such as those shown in FIGS. 4–6 may be employed. In FIG. 4, serrations 120 are in the form of rounded indentations and have a substantially semicircular sectional shape. The serrations on the first surface 22 are symmetrically positioned opposite the serrations on the second surface 24 and separated therefrom by a separating portion 122 of the strap so that the strap is reduced to approximately one-third of the normal thickness. Score lines or serrations of the type illustrated substantially increase the flexibility of the strap and the closer such score lines are placed to each other the more flexible the strap. Also, if fracture occurs during use of the tool 100, it will occur at the separating portions 122.

Although the rounded indentation scoring of FIG. 4 does not preclude fracture, the scoring on the strap in FIG. 5 is designed to induce fracture of the working element as a result of use of the tool. In FIG. 5, the serrations or score lines 124 have a substantially triangular sectional shape and are in the form of a sharp V terminating inwardly in a relatively sharp notch 125. Fracture of the strap 20 during use of the tool will occur at such notch 125. Thus the serrations 124 create a designed weakness which will break upon use of the tool resulting in similar advantages as the series of slits 108.

FIG. 6 illustrates scoring having the same configuration as in FIG. 5 but with the parallel scoring in the form of triangular serrations 126 more widely spaced than serrations 124. The width of the generally rectangular finger which is formed when fracture does occur at serrations 126 during use of the tool will be greater than the fingers formed by serrations 124. Thus, the spacing of the serrations or score lines controls the degree of flexibility or aggressiveness of the tool. In any event, the strap 20 may be partially embossed, serrated or scored to provide the degree of flexure desired and/or to provide fracture lines.

Reverting to FIGS. 12 and 13, the shank 104 of the tool 100 is substantially the same as the shank 44 of the tool 32 except that shank 104 is made of plastic instead of metal. This results in the shank 104 being approximately one-third the weight of a metal shank of similar size. The shank 104 may be formed of a non-brittle plastic such as nylon as long as the plastic material has sufficient strength to absorb the hoop stress as the rolled strap 102 is driven into the interior of the cup portion of the shank. The plastic shank will result in a lighter weight tool requiring less torque for rotation and if employed on the end of a robotic arm, the lighter weight provides quicker and more accurate positioning of the tool.

Figure 16:
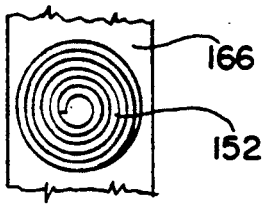
FIG. 16 is a top view of the coiled strap shown in FIG. 15.
Figure 15:
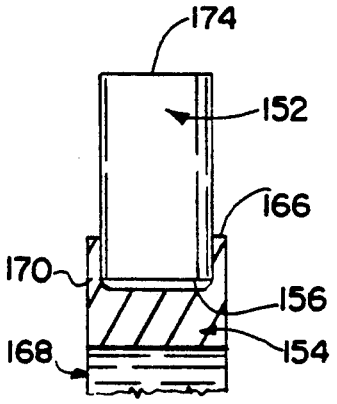
FIG. 15 is an enlarged radial section of one of the coiled straps as seen from line 15—15 of FIG. 14.
Figure 14:
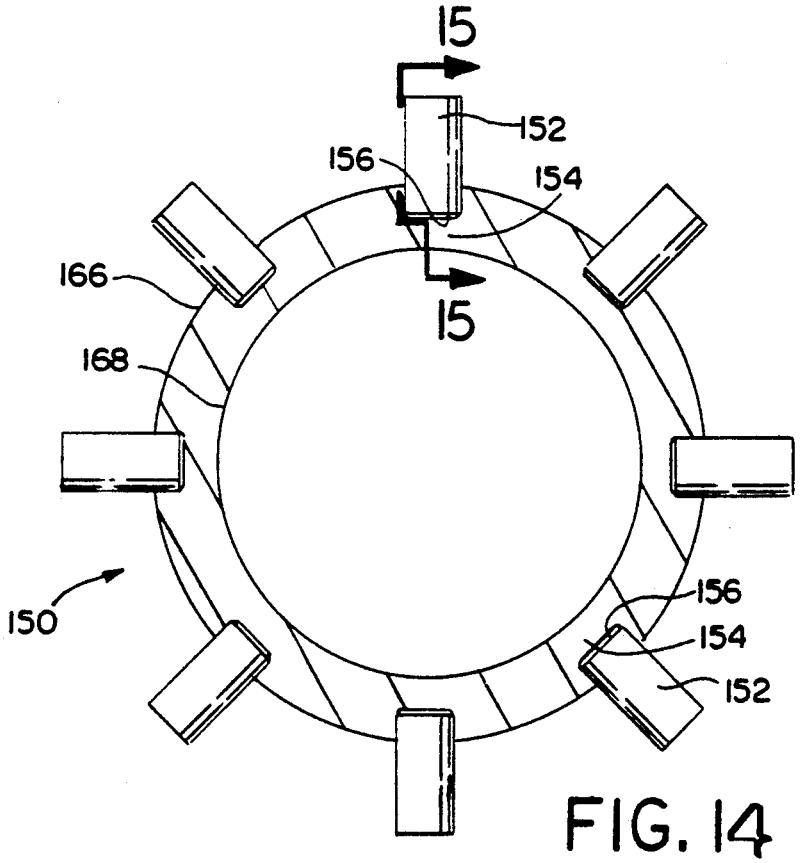
FIG. 14 is an axial view partly in section of another rotary finishing tool according to the present invention having a hub containing a plurality of cups into which coiled straps are secured.

A further embodiment of the present invention, a finishing tool 140, is shown in FIGS. 14–16. The tool 150 includes a plurality of rolled straps 152 secured in cup elements, or sockets, 154 by a thin layer of adhesive 156 in the bottom of each socket. The cup sockets 154 differ somewhat from the shanks shown in FIGS. 10 and 14. Each cup socket 154 is a cylindrical recess equally spaced around a circumferential face 166 of a metal or plastic disc, or hub, 168.

The cup sockets 154 differ from the shanks discussed above in another aspect in that they are not as deep. The annular wall 170 of each socket extends axially around the coiled strap 152 less than one-fifth the axial length of the coiled strap 152. In this manner, very little abrasive material is wasted when compared to the deeper cup-shape portions of tools 32 and 100. This aspect is especially useful with straps including more expensive abrasives such as polycrystalline diamond. In its preferred form, the annular wall 170 will cover about one-half inch of the width of the coiled strap. The coiled strap is preferably between 2½ inches to 4½ inches in axial length so that when it is installed in the cup element, a 2–4 inch trim is provided.

Although the tool 140 is not shown slitted or serrated, such scoring/slits may be provided extending perpendicular to the top face 174 of the coiled straps 152. In the case of scoring, the entire strap may be scored. If slit, the slits should preferably be dimensioned so that they extend to an area adjacent the annular wall 170, or approximately four-fifths the axial length of a coiled strap 154.

One may appreciate that the present invention provides simple and easily constructed adhesive bonded abrasive finishing tools. The tools nonetheless have significant advantages when compared to tools using "hairpin" anchors or rings, sleeves or locking pins. Further, because the tools are made from rolled or coiled straps, rather than discrete monofilaments, the manufacture of such tools is much simplified. Still further, the strap may be modified to provide various degrees of flexibility and/or aggressiveness.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A rotary finishing tool comprising:

a cup element having a bottom interior surface and an annular cup wall projecting axially thereof and terminating in a rim; and a coil of strap of an abrasive containing plastic material, said coil having a first end face, a second end face and an axial generally cylindrical coil wall of a certain length therebetween;

said first end face of said coil being secured to said bottom interior surface of said cup element, while said second end face projects beyond said rim to be the only working face of the tool.

2. A tool as set forth in claim 1 wherein said first end face of said coil is secured to said bottom interior surface by a layer of instant adhesive.

3. A tool as set forth in claim 1 wherein said strap includes a series of slits extending from, and in a direction perpendicular to, said second end face to form fingers each parallel to the axis of the tool.

4. A tool as set forth in claim 3 wherein said slits extend from said second end face a distance equal to approximately two thirds of said length of said generally cylindrical coil wall.

5. A tool as set forth in claim 1 wherein said strap when in a flattened form is a rectangular strap having a first major surface and a second major surface, and a series of serrations for promoting fracture during use of the tool in at least one of said major surfaces; said serrations extending in a direction perpendicular to said second end face when said strap is coiled.

6. A tool as set forth in claim 5 wherein said coiled strap includes a series of serrations in both said first major surface and said second major surface.

7. A tool as set forth in claim 6 wherein said serrations in said first major surface are positioned opposite said serrations in said second major surface and separated therefrom by a separating portion.

8. A tool as set forth in claim 7 wherein said serrations have a substantially semicircular sectional shape.

9. A tool as set forth in claim 7 wherein said serrations have a substantially triangular sectional shape.

10. A tool as set forth in claim 1 wherein said cup annular wall embraces said coil along a distance approximately one-third of the axial length of said generally cylindrical coil wall.

11. A tool as set forth in claim 1 wherein said adhesive in its uncured form has a low viscosity and completely covers the bottom interior of said cup element.

12. A tool as set forth in claim 11 wherein said adhesive is cyanoacrylate.

13. A tool as set forth in claim 1 wherein said cup element is plastic.

14. A tool as set forth in claim 1 wherein said cup element is metal.

15. A tool as set forth in claim 1 wherein said plastic abrasive material is made of a plastic selected from a group consisting of nylons, aramids, polyimides and polyesters.

16. A tool as set forth in claim 1 wherein said plastic abrasive material is abrasive loaded nylon.

17. A tool as set forth in claim 1 wherein said strap contains from about 30 to about 45% by weight of abrasive grains embedded homogeneously therein throughout.

18. A tool as set forth in claim 1 wherein said strap has a length, width and thickness, the width to thickness ratio being at least about 10 to 1.

19. A tool as set forth in claim 18 wherein the thickness of said strap is about one millimeter.

20. A tool as set forth in claim 1 wherein said plastic is 6/12 nylon.

21. A tool as set forth in claim 1 wherein said cup element includes an axially projecting arbor to be gripped by the collet of a power tool.

22. A tool as set forth in claim 1 wherein said cup element includes a cylindrical opening along a circumferential face of a cylindrical hub.

* * * * *